United States Patent [19]

Chia

[11] 4,066,475

[45] Jan. 3, 1978

[54] METHOD OF PRODUCING A CONTINUOUSLY PROCESSED COPPER ROD

[75] Inventor: E. Henry Chia, Carrollton, Ga.

[73] Assignee: Southwire Company, Carrollton, Ga.

[21] Appl. No.: 696,801

[22] Filed: June 16, 1976

Related U.S. Application Data

[63] Continuation-in-part of Ser. No. 509,372, Sept. 26, 1974, abandoned.

[51] Int. Cl.[2] ..... B22D 11/12

[52] U.S. Cl. ..... 148/3; 164/82; 427/434 D; 427/434 E; 427/435

[58] Field of Search ..... 148/3; 427/434 D, 434 E, 427/435; 164/82

[56] References Cited

U.S. PATENT DOCUMENTS

| | | | |
|---|---|---|---|
| 1,977,932 | 10/1934 | Wright | 427/434 D |
| 2,565,959 | 8/1951 | Francis et al. | 148/3 |
| 3,257,835 | 6/1966 | Cofer et al. | 164/76 |
| 3,331,123 | 7/1967 | Cofer | 164/76 |
| 3,349,471 | 10/1967 | Bell et al. | 148/3 |

*Primary Examiner*—W. Stallard

*Attorney, Agent, or Firm*—Van C. Wilks; Herbert M. Hanegan; Stanley L. Tate

[57] ABSTRACT

In a continuous casting system where molten copper is cast into a bar and then rolled into a rod, the copper rod is immediately hot-coiled before being subjected to any quenching or cooling operation. The hot-coiling of the rod is carried out at a temperature of from 700° F. to 1200° F. and preferably within a range of from 950° F. to 1150° F., so that the rod is hot-coiled at a high enough temperature to permit sufficient thermal vacancy diffusion to occur within the rod material, and thereafter gradually cooled to room temperature to thereby impart certain improved mechanical properties to the resultant rod product. A copper or copper alloy rod which is processed in this fashion has a lower yield tensile strength, lower ultimate tensile strength, lower recrystallization temperature, lower hardness and is much more ductile and hence easier to draw into wire than a corresponding rod which is quenched or cooled prior to coiling.

10 Claims, 2 Drawing Figures

METHOD OF PRODUCING A CONTINUOUSLY PROCESSED COPPER ROD

CROSS-REFERENCE TO RELATED APPLICATION

This application is a continuation-in-part of copending application Ser. No. 509,372, filed Sept. 26, 1974, now abandoned.

BACKGROUND OF THE INVENTION

In recent years, much effort has been expended in the metallurgical field to develop techniques for continuously casting molten metal into continuous metal rod. The advantages of continuous casting over batch casting are well known in the art and include the elimination of such prior art batch casting operations as initially casting individual bars of the metal, cooling the bars and casting molds, stripping the bars from the casting molds, and then reheating the bars to a sufficient temperature so that they may be rolled into lengths of rod.

For example, the prior art production of copper rod from cast copper wire bars, typically weighing 250 pounds, included reheating the cast bars to 1700° F in order to homogenize the metal and condition it for the subsequent hot-forming operation, and thereafter rolling the bars in a so-called "looping mill" which was a long, slow operation that permitted the rod to completely recrystallize between rolling passes. After rolling, the copper rod would be completely covered with a black oxide coating, and no cold work (stored energy) would remain in the rod as it exited the mill at 1000° F. The 250 pound length of rod emitting from the looping mill was taken-up on a coiling device and immediately quenched to facilitate subsequent handling. Inasmuch as no stored energy remained in the rod as it exited the mill, the quenching operation did not affect its metallurgical properties.

In the continuous production of metal rod according to present practice, on the other hand, molten metal passes from a holding furnace into.the mold of a casting wheel where it is cast into a metal bar. The solidified metal bar is removed from the casting wheel and directed into a rolling mill where it is rolled into continuous rod. Depending upon the intended end use of the metal rod product, the rod may be subjected to cooling during rolling or the rod may be cooled or quenched immediately upon exiting from the rolling mill to impart thereto the desired mechanical properties. As disclosed in U.S. Pat. No. 3,395,560 to Cofer et al., a continuously-processed rod is preferably cooled as it exits the rolling mill and prior to being coiled. Because the continuous casting and rolling operation does not include the intervening homogenizing step of the prior art batch casting of wire bars, and because the rolling operation is relatively rapid as compared with the prior art looping mill, the continuous rod emitting from the rolling mill will have a substantial amount of cold work retained therein and thus the immediate quenching operation will serve to retain the same and freeze impurities in solid solution thus improving the tensile strength of the product.

Conventional cooling techniques include immersing the rod in a coolant, and spray-cooling the rod with coolant. In all cases, however, it is standard practice to cool or quench the continuously produced rod prior to its coiling and rods formed in this manner are hereinafter referred to as cold-coiled rods in contrast to the hot-coiled rods of the present invention.

In some instances, it is desirable to have uniformly dispersed copper oxide inclusions throughout the rod product whereas in other instances, it is necessary to remove such oxide by shaving or scalping operations. The oxide and other surface scale may be removed from the rod product by pickling the surface of the rod in a liquid such as sulfuric, nitric or other acids. The pickling operation also performs a cooling function so that it is possible to both cool and pickle the rod in one operation and one example of such a system for quench-pickling cast rod is shown in U.S. Pat. No. 3,623,532 to Cofer et al. Rods formed in this manner are also cooled, due to the pickling operation, prior to their delivery to a coiling apparatus and therefore are cold-coiled.

One disadvantage of the prior art systems for continuous production of metal rod is that due to the cooling operation, the rod becomes harder and hence more difficult to coil. This is particularly disadvantageous with large diameter rod. Another disadvantage of quenching the high temperature rod prior to coiling is that the retained vacancies and lattice defects which are present after quenching remain in the rod since the temperature of the quenched rod is too low to enable these defects to be rectified through thermal vacancy diffusion. For many applications, such as wire drawing, rod which is quenched prior to coiling becomes too hard and will have too high a yield tensile strength and too high a degree of residual stress to be commercially suitable.

Additionally, rod quenched at high temperatures as it exits the rolling mill will exhibit a high recrystallization temperature because impurities contained in the metal will be trapped or frozen in solid solution. Consequently, the rod will have a high annealing temperature which obviously necessitates appropriate process equipment and energy requirements capable of effecting the high temperature anneal. Moreover, when the rod is drawn into wire intended to be subsequently fabricated into magnet wire by coating the same with an enameling composition in an annealing tower, a high temperature anneal (e.g., greater than 500° F) will cause the enamel to blister on the surface of the wire. Consequently, under these circumstances the annealing and enameling would have to be effected in separate operations.

SUMMARY OF THE INVENTION

According to the present invention, a continuous length of copper or copper alloy rod is coiled as it exits from a rolling mill and prior to any quenching or cooling operations, and thereafter gradually cooled to room temperature. The rod is hot-coiled under temperature-controlled conditions to selectively impart desired characteristics to the rod before the rod has had an opportunity to cool. By coiling the rod in this manner, a much lesser degree of vacancies and lattice defects are ultimately retained in the final rod product, the ductility of the rod is improved, the recrystallization temperature is lowered, the yield tensile strength is lowered and the rod has a lesser degree of residual stress than rods of similar composition which are cold-coiled.

Therefore it is an object of the present invention to provide a method for treating copper and copper alloy rod during its formation so as to improve certain mechanical properties of the rod, and to improve a rod product formed by such method.

Another object of the present invention is to provide a method of producing copper and copper alloy rod by hot-coiling the rod to impart thereto increased ductility, lower yield tensile strength, and a lesser degree of residual stress than may otherwise be obtained, and to provide a rod product formed by such method.

A further object of the present invention is to provide a method of continuously producing copper and copper alloy rod having certain predetermined properties by hot-coiling the rod at elevated temperatures as it exits from a rolling mill and prior to any quenching or cooling, and to provide a rod product formed by such method.

A still further object of the present invention is to provide, in a continuous casting system for producing copper and copper alloy rod, a method of imparting certain predetermined properties to the rod by hot-coiling the same, and to provide a rod product formed by such method.

Yet another object of the present invention is to provide a method of coiling metal rod of large diameter by hot-coiling the rod, and to provide a rod product formed by such method.

A still further object of the present invention is to provide a metal rod having certain predetermined mechanical properties which are imparted thereto by hot-coiling the rod.

Still another object of this invention is to provide a method of producing a continuously processed copper rod having a lower yield tensile strength, elongation and recrystallization temperature than conventionally processed copper rod.

Still another object of this invention is to produce a continuously processed copper rod having a low annealing temperature whereby magnet wire may be produced under conditions wherein the annealing and application of the enameling compound are simultaneously effected.

Having in mind the above and other objects, features and advantages of the invention that will be evident from an understanding of this disclosure, the present invention comprises the method and resultant product as illustrated in the presently preferred embodiment of the invention which is hereinafter set forth in sufficient detail to enable those persons skilled in the art to clearly understand the function, operation, and advantages of it when read in conjunction with the accompanying drawings.

DESCRIPTION OF THE PREFERRED EMBODIMENT

Figure 1:
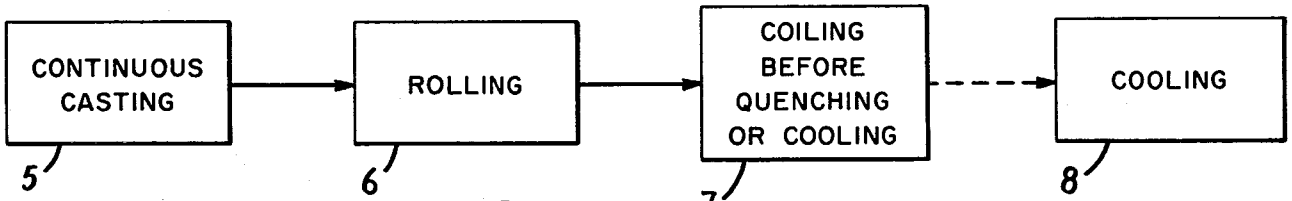
FIG. 1 is a block diagram depicting the major operations of a continuous casting system employing the method of the present invention.

According to one aspect of the present invention and with reference to FIG. 1, the method of the invention comprises the steps of continuously casting 5 molten metal into a cast metal bar, rolling 6 the cast bar while at high temperature into a metal rod, and coiling 7 the metal rod before subjecting the same to any quenching or cooling operations. In this fashion, the metal rod is hot-coiled immediately after being rolled and while at the high temperature at which it was rolled. The coiled rod may then be gradually cooled 8 to room temperature.

Figure 2:
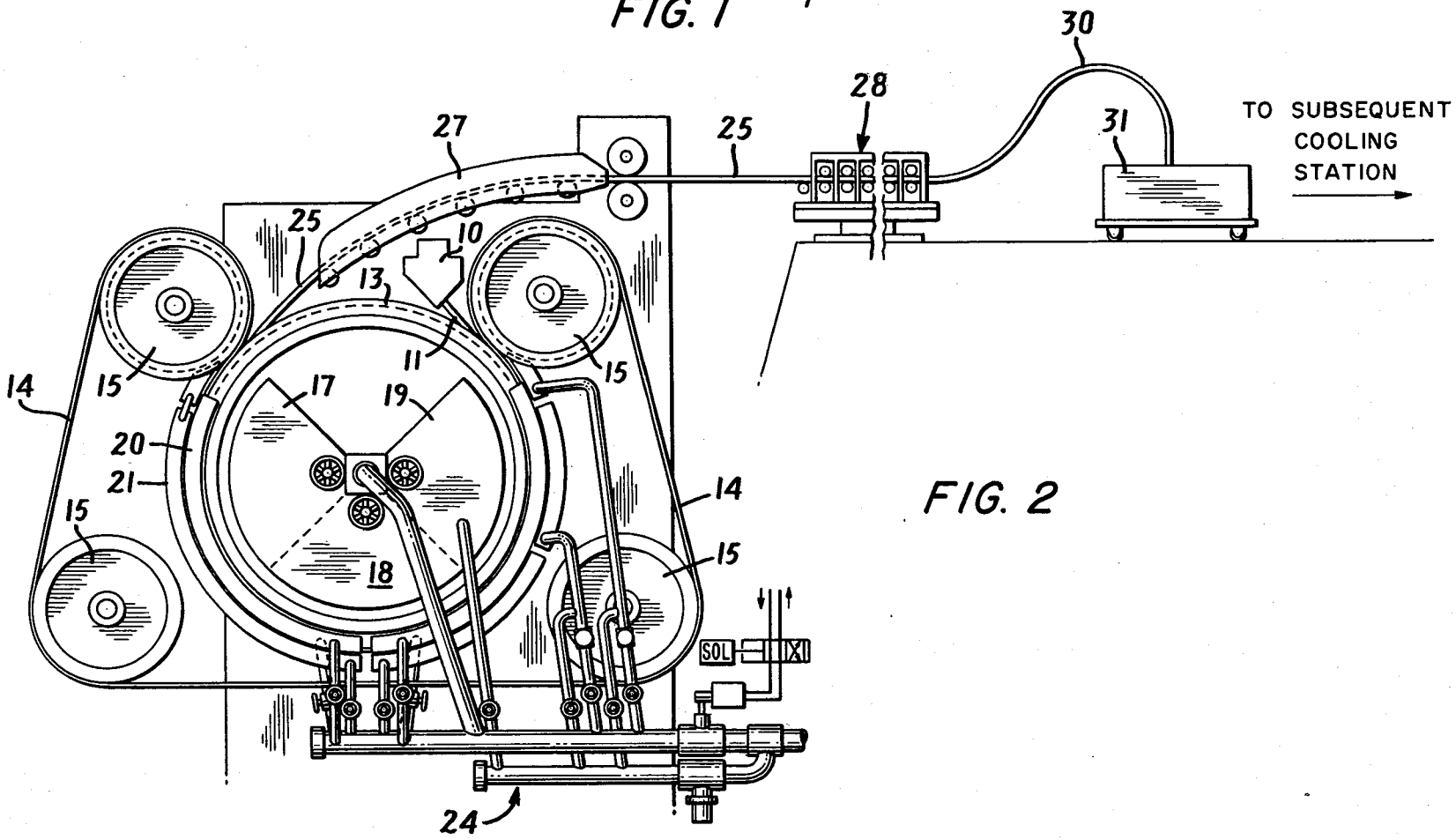
FIG. 2 is a schematic view of a continuous casting system arranged to carry out the method of the present invention.

One type of apparatus which may be used to carry out the method of the invention is shown schematically in FIG. 2. The apparatus comprises a continuous casting system comprising a delivery device 10 which receives molten copper metal containing normal impurities and delivers the metal to a pouring spout 11. The pouring spout 11 directs the molten metal to a peripheral groove contained on a rotary mold ring 13. An endless flexible metal band 14 encircles both a portion of the mold ring 13 as well as a portion of a set of band-positioning rollers 15 such that a continuous casting mold is defined by the groove in the mold ring 13 and the overlying metal band 14 between the points A and B. A cooling system is provided for cooling the apparatus and effecting controlled solidification of the molten metal during its transport on the rotary mold ring 13. The cooling system includes a plurality of side headers 17, 18, and 19 disposed on the side of the mold ring 13 and inner and outer band headers 21 and 22, respectively, disposed on the inner and outer sides of the metal band 14 at a location where it encircles the mold ring. A conduit network 24 having suitable valving is connected to supply and exhaust coolant to the various headers so as to control the cooling of the apparatus and the rate of solidification of the molten metal. For a more detailed showing and explanation of this type of apparatus, reference may be had to U.S. Pat. No. 3,596,702 to Ward et al.

By such a construction, molten copper metal containing normal impurities is fed from the pouring spout 11 into the casting mold at the point A and is solidified and partially cooled during its transport between the points A and B by circulation of coolant through the cooling system. Thus by the time the cast bar reaches the point B, it is in the form of a solid cast bar 25. The solid cast bar 25 is withdrawn from the casting wheel and fed to a conveyor 27 which conveys the cast bar to a rolling mill 28. It should be noted that at the point B, the cast bar 25 has only been cooled an amount sufficient to solidify the bar and the bar remains at an elevated temperature to allow an immediate rolling operation to be performed thereon. The rolling mill 28 comprises a tandem array of rolling stands which successively roll the bar into a continuous length of wire rod 30 which has a substantially uniform, circular cross-section.

In accordance with the invention, the wire rod 30 is not quenched or cooled after its formation but rather is immediately fed to a coiler 31. The coiler in the embodiment shown comprises a coiling basket which receives the wire rod 30 and coils the same into extremely long lengths of coiled rod. The coiling operation occurs immediately downstream from the rolling operation without any intervening quenching or cooling. After the rod is coiled, it is delivered to a subsequent cooling station for gradual cooling to room temperature to permit precipitation of substantially all of the impurities from solid solution thereby lowering the recrystallization temperature of the rod.

It is a metallurgical postulate that impurities in solid solution will raise the recrystallization temperature of the product. Moreover, the impurities in copper (e.g., iron, silver, tin and lead) are additive in increasing the recrystallization temperature. Consequently, by permitting precipitation of substantially all the impurities from solid solution as abovedescribed, the recrystallization temperature of the copper rod will be substantially lowered as compared with the recrystallization temperature of rod produced by prior art processes wherein the rod is immediately quenched upon exit from the rolling mill. As a result of the lowered recrystallization temperature, the continuously-produced rod may be annealed at lower temperatures in order to achieve minimum elongation requirements. It should be apparent that the low temperature anneal is desirable in order to reduce oxidation and also to conserve energy and increase the life of process equipment. Moreover, in the production of magnet wire having an enameled coating thereon, it is advantageous if the annealing and enameling can be effectuated simultaneously in the annealing tower. If annealing at temperatures greater than 500° F is required, the enamel will blister on the surface of the rod. On the other hand, if the annealing can be accomplished at temperatures lower than 500° F, enameling and annealing can be effectuated simultaneously in an annealing tower at about 500° F.

A significant feature of the present invention resides in the discovery that rolled rods which are first quenched and then coiled are at too low a temperature to permit vacancy diffusion to occur and therefore such rods possess certain mechanical properties which are undesirable. From an examination of cold-coiled rods, it was learned that they possessed a high degrees of vacancies and lattice defects which were quenched in the rods and since vacancy concentrations in most metals increase with increasing temperature, the high degree of vacancies is believed to be due to the fact that the temperature of the quenched rods is too low to permit these defects to be rectified through thermal vacancy diffusion or thermal recovery of the existing high dislocation density material. When the metal is hot rolled, the last two or three rolls produce a high dislocation density in the metal matrix due to the fact that a great portion of this deformation is "warm rolling" which produces a high percentage of cold work to the matrix. This cold work is produced by the generation of dislocations and defects which would be held-in by a quick water quench. As a result, the rod is hard and not easily bendable and as a consequence, it is difficult to coil such rods, especially those of large diameter. The present invention allows thermal recovery of these defects to a certain degree so as to provide improved mechanical properties in the coiled rod.

By the way of example only, the results of two comparative tests will be given so that the advantages of the invention will be more readily apparent. In both examples, the chemical composition of the copper alloy rod, in parts per million, is as follows:

| Pb | Sn | Ag | Sb | Fe | Mn | As | Bi |
|---|---|---|---|---|---|---|---|
| 5 | 1 | 1 | 1 | 1 | 1 | <1 | <1 |

EXAMPLE 1 (COLD-COILED ROD)

A length of copper alloy rod having the foregoing chemical composition was formed by continuous casting of molten metal into cast bar followed by rolling the bar into metal rod of ⅜ inch diameter. The metal rod was then quenched and cooled to room temperature, between 80°–100° F., after which the cooled rod was coiled in a coiling apparatus. The following mechanical properties of the rod were measured:

| | |
|---|---|
| Ultimate tensile strength | 31–32 KSI |
| Yield tensile strength | 16.5–17.5 KSI |
| Elongation (10") | 40–41% |
| Rockwell F. Hardness | 50 |

EXAMPLE 2 (HOT-COILED ROD)

A copper alloy rod was formed by casting and rolling in the same manner as described above in Example 1 only in this case, the rolled rod was immediately fed to the coiling apparatus and coiled in a hot condition before any quenching or cooling operation. The copper alloy rod was delivered directly from the rolling mill and coiled while at a temperature of 1110° F. and after the rod was gradually cooled to room temperature, the following mechanical properties were measured:

| | |
|---|---|
| Ultimate tensile strength | 30–31 KSI |
| Yield tensile strength | 12–13 KSI |
| Elongation (10") | 43–44% |
| Rockwell F Hardness | 42 |

From a comparison of the two Examples, the improved results obtained from hot-coiling the copper alloy rod as opposed to cold-coiling the copper alloy rod are readily seen. One significant result is that the yield tensile strength decreased from the 16,000 psi range to the 12,000 psi range. This lower yield tensile strength results in a more ductile rod which is easier to process, especially easier to draw into wire.

Another significant result is that the Rockwell F Hardness decreased from about 50 to about 40 with the attendant result that the ductility of the rod was increased thereby making the rod easier to cold form, such as by drawing. This is evidenced by the increase in elongation of the hot-coiled rod as opposed to the cold-coiled rod. The Examples given above are representative only and similar results are obtained using any copper and copper alloy materials which are currently employed in the art and comparing the mechanical properties of cold-coiled versus hot-coiled rods made from those materials.

In accordance with the present invention, it has been found that the rod-coiling temperature should lie within 700° F. to 1200° F. in order to permit adequate thermal vacancy diffusion to occur since the vacancies are not quenched at this temperature range and recovery of the residual cold working imparted during rolling of the rod will therefore occur. This temperature range is suitable particularly for copper and copper alloy rods. Also, the region within 950° F. to 1150° F. has been found to be especially effective in imparting the foregoing desirable mechanical properties to the rod and therefore the preferred temperature range for the rod-coiling is from 950° F. to 1150° F.

It has also been found in accordance with the invention that the hot-coiled rod should be grandually cooled to room temperature at a cooling rate not exceeding 300° F. per minute in order to permit precipitation of substantially all of the impurities from the copper rod.

Thus it will be seen that in accordance with the present invention, a copper rod is produced which has certain predetermined mechanical properties which were not heretofore obtainable by coiling the rod in the conventional manner. The rod product formed in accordance with the method of the invention is annealable at a lower temperature than a cold-coiled rod and has a lower yield tensile strength and lower hardness than corresponding rod which is cold-coiled.

While the invention has been disclosed with reference to one preferred embodiment, it is understood that many modifications and changes will become apparent to those ordinarily skilled in the art and the present invention is intended to cover all such obvious modifications and changes which fall within the spirit and scope of the invention as defined in the appended claims.

What is claimed is:

1. A method of producing a continuously processed copper rod having a lower yield tensile strength, elongation and recrystallization temperature than conventionally processed copper rod comprising the steps of:

a. continuously casting molten copper containing normal impurities into a cast bar at a rate at which said impurities are trapped in solid solution;

b. substantially immediately hot-rolling the cast bar in the as-cast condition into continuous rod at a rate at which said impurities are retained in solid solution;

c. hot-coiling the continuous rod prior to any substantial cooling thereof from the hot-rolling temperature; and d. gradually cooling the coiled rod to room temperature to permit precipitation of substantially all of said impurities thereby lowering the recrystallization temperature of the rod.

2. A method according to claim 1, wherein said coiling is carried out while the rod is at a temperature of from 700° F. to 1200° F.

3. A method according to claim 1, wherein said coiling is carried out while the rod is at a temperature of from 950° F. to 1150° F.

4. A method according to claim 1, wherein the coiled rod is gradually cooled to room temperature at a cooling rate not exceeding 300° F. per minute.

5. A method according to claim 1, wherein the recrystallization temperature of the rod is sufficiently lowered to permit annealing thereof at 500° F.

6. A method of producing an enameled copper magnet wire comprising the steps of:

a. continuously casting molten copper containing normal impurities into a cast bar at a rate at which said impurities are trapped in solid solution;

b. substantially immediately hot-rolling the cast bar in the as-cast condition into continuous rod at a rate at which said impurities are retained in solid solution;

c. hot-coiling the continuous rod prior to any substantial cooling thereof from the hot-rolling temperature;

d. gradually cooling the coiled rod to room temperature to permit precipitation of substantially all of said impurities thereby lowering the recrystallization temperature of the rod; and e. passing the rod through an annealing tower containing a molten enameling compound at about 500° F. and therein simultaneously annealing the rod and coating it with the enameling compound.

7. A method according to claim 6, wherein said coiling is carried out while the rod is at a temperature of from 700° F. to 1200° F.

8. A method according to claim 6, wherein said coiling is carried out while the rod is at a temperature of from 950° F. to 1150° F.

9. A method according to claim 6, wherein the coiled rod is gradually cooled to room temperature at a cooling rate not exceeding 300° F. per minute.

10. A method according to claim 6, wherein the recrystallization temperature of the rod is sufficiently lowered to permit annealing thereof at 500° F.

* * * * *